United States Patent [19]

Shoemaker

[11] Patent Number: 4,739,628

[45] Date of Patent: Apr. 26, 1988

[54] EXTENDED RANGE HEAT PUMP SYSTEM AND CENTRIFUGAL COMPRESSOR FOR USE THEREWITH

[76] Inventor: James F. Shoemaker, 6264 Kinsey Pl., St. Louis, Mo. 63109

[21] Appl. No.: 935,950

[22] Filed: Nov. 28, 1986

[51] Int. Cl.[4] ..... F04B 41/06; F25B 13/00

[52] U.S. Cl. ..... 62/324.6; 62/510; 417/2

[58] Field of Search ..... 62/510, 175, 324.6, 62/160, 196.3; 417/2/289

[56] References Cited

U.S. PATENT DOCUMENTS 2,453,095 11/1948 McGrath ..... 417/2 X

*Primary Examiner*—William E. Wayner

*Attorney, Agent, or Firm*—Haverstock, Garrett & Roberts

[57] ABSTRACT

Improvements in heat pump systems having indoor and outdoor heat exchangers, at least two compressors, and conduit connections including associated compressor selector and change over valves operable to control the direction of flow of fluid medium through the heat exchangers from the compressors, and to control whether one or more of the compressors will be operating the system and in all cases to connect the operating compressor or compressors in series with the heat exchangers. The present invention also resides in a novel construction of a centrifical compressor for use in the heat pump system including a compressor having a housing with rotatable structure mounted therein, the rotatable structure having a pump portion for sucking fluid medium into the compressor and least three space wall members with convoluted fins positioned therebetween the direct the incoming fluid medium radially outwardly while accelerating the velocity of the medium and thereafter radially inwardly while retarding the velocity of the medium and if necessary repeating this process several times or more.

8 Claims, 3 Drawing Sheets

EXTENDED RANGE HEAT PUMP SYSTEM AND CENTRIFUGAL COMPRESSOR FOR USE THEREWITH

BACKGROUND OF THE INVENTION

This invention relates generally to a heat pump or reversible refrigeration system, and more particularly, to a multi-stage heat pump system and a novel centrifugal compressor for use therewith which together provide an extended operating capacity including a substantially greater heating range.

DISCLOSURE OF THE PRIOR ART

The heat pump has been widely used to heat and cool inhabited areas including homes, offices and other enclosed spaces for many years, and is based on vapor compression refrigeration systems which have been in use over several decades.

These electrically driven heating/cooling devices for residential and small commercial use are essentially reversible refrigeration systems, generally using reciprocating compressors. They are highly regarded for their cooling performance and heating at moderate temperatures, but they have the following basic unfavorable features: (1) at temperatures below about 30° F. they require supplemental heating in a rapidly escalating manner because of decreased output and increased need; (2) the coefficient of performance (COP) drops significantly at the lower end of the operating range (from about 3.5 to 1.7), and the output thereat is way below rated capacity; and (3) reciprocating compressors have about twelve to fifteen years life expectancy for air conditioning service alone and then need to be replaced. With the added duty in the heating mode, compressor designs are more demanding and expensive in order to maintain comparable life expectancy.

The present heat pump system is a reversible compresssion refrigeration system, as are conventional small heat pumps, but some of its components and their configuration are substantially different. It is designed with a selective dual compressor arrangement for normal heating/cooling operation and extended range self-contained heating capability for temperatures from about −10° F., while maintaining an indoor temperature of 75° F. The present system uses dual compressors which are identical and are of a special centrifugal-type design which provides relative ease of manufacture, reliability, and smooth operation. The present compressors can either be direct driven or gear driven, preferably through a planetary gear system, and can be coupled to a single phase compound field motor as shown in U.S. Pat. No. 4,464,618. Such compressors should be capable of substantially longer life expectancy than conventional reciprocating compressor systems and the longer life expectancy is enhanced by the dual compressor arrangement whereby one compressor and motor unit is idle except during the coldest season of the year. Compound field motors are well suited for the load duty of the present system because of their smooth running characteristics, high power factor and efficiency over an extensive load range, and the present centrifugal compressor construction is naturally suited to the present system because of its variable capacity output characteristic and freedom from reciprocating stresses. On the other hand, reciprocating compressors are not readily adaptable to this design because of their constant volume feature.

One compressor and motor operating at about 60% power can provide the cooling system and heating to about 30° F., and both compressors and motors at 100% load will provide the full extended range capacity. This power range which represents a factor of about 3.5 to 1 can transfer up to 100% more heating BTU's than are required for cooling over a temperature range in excess of two times that required in the cooling mode. The increased BTU flow is possible because of increased compressor head with both compressors operating, arrangement for an automatic increase in the capacities of condenser and evaporator with reverse flow, use of a temperature sensitive outdoor expansion valve coordinated with the variable output of the centrifugal compressor, and the nature of the pressure/enthalpy relationship in the deep heating mode, namely a decrease in BTU's required from the outside air. With this system it should be possible to achieve a coefficient of performance of about 2.0 at temperatures at or near −10° F. and at rated capacity. Furthermore, all functions of the extended range heat pump can be controlled by the application of conventional pressure, temperature, and timing devices.

Prior art patents in the area of multiple compressors essentially show two compressors in series with various control means. They apply most generally to positive displacement compressors (reciprocating), consisting of high and low pressure stages with the high pressure unit as the mainstay and the low pressure stage as the auxiliary for a more extended operating range. The following disadvantages are inherent in these systems: (1) positive displacement compressors at constant speed intake the same volume but less weight of refrigerant as ambient temperatures decrease,thus, as more refrigerant is needed for heat transfer, its availability decreases; (2) significant amounts of compression heat are utilized which is very inefficient; and (3) some systems use external heat sources for input to the refrigerant which is also very inefficient.

In addition, a frequently used method for controlling refrigerant conditions is a by-pass means referred to as a quench circuit. It is used to limit the pressure and temperature to safe values under extreme conditions with both compressors operating. This is an especially inefficient expedient as the by-passed refrigerant is not routed through the outside heat exchanger for heat pick up from the outside air, further reducing the heat transfer capability of an already starved system.

The prior art shows no significant emphasis toward centrifugal compressors to solve these problems. This application addresses this subject and covers the principles and design of my novel compressor. Conventional centrifugal compressors would suffice operationally, but they are prohibitively complex and expensive for this application.

SUMMARY OF THE INVENTION

The present invention resides in improvements to a reversible compression refrigeration system, commonly known as a heat pump system, which provide greater heating capacity achieved through the introduction of a novel centrifugal compressor construction which substantially improves the wearability and useful lifetime of such compressors through the introduction of means for selectively utilizing any one or more of the compressors provided in such a system at any one time.

The present heat pump system is characterized by a pair of heat exchangers, each of which is capable of serving alternatively as an evaporator and as a condenser unit; at least two novel centrifugal compressor units connected to operate in series relation or alternatively to operate individually; a four-way reversing valve which interconnects a conduit arrangement carrying refrigerant between the compressors and the heat exchangers; and a selection valve associated with each of the compressor units. Unlike prior art systems, the present system allows any one or more of the compressor units to be operated at any time. The selection valve associated with each individual compressor serves to direct a flow of refrigerant either through the associated compressor unit or, by closing off the flow through the respective compressor, directs the refrigerant flow through a bypass conduit to another of the compressors or on to the heat exchangers. The obvious advantage of such selective compressor use is that wear on the compressors is substantially reduced as compared to the prior art compressors because the usage load can be spread between and among the several compressor units.

The improved heating capabilities of the present system are achieved through the use of a centrifugal compressor construction that is substantially smaller in size, is less complex and less expensive to manufacture and operate than prior art compressors. The present centrifugal compressors include a series of consecutive internally staged impeller units which are arranged together in a single compression unit such that refrigerant is transferred immediately from one impeller unit to an adjacent impeller unit without the need for the relatively complex series of conduits and refrigerant flow lines found in prior art centrifugal compressors.

Further, the present system is intended to be used with a novel outdoor heat exchanger construction that lowers the pressure of the air stream forced over the heat exchanger coils, thereby decreasing the dew point of the air stream and reducing condensation formation on the outdoor coils. This should be possible with an appropriate change in the cross sectional area of the air stream path. Lessening this condensation reduces the possibility that ice will form on the outdoor coils, requiring defrosting.

It is therefore a principal object of the present invention to provide an improved heat pump system that can be efficiently operated over an extended outdoor ambient temperature range.

Another object is to enable the subject heat pump system to provide greater heating capacity and to operate efficiently even at low ambient outdoor temperatures.

Another object is to provide an improved centrifugal compressor construction which is less complex and less expensive to manufacture.

Another object is to facilitate the manufacture and operation of an improved centrifugal compressor and one which occupies a relatively smaller space in a heat pump system than is true of known systems.

Another object is to provide a centrifugal compressor capable of condensing a larger weight of refrigerant under most conditions than known systems and thereby increase the efficiency and heat carrying capacity of the system.

Another object is to provide an improved compressor configuration in an extended range heat pump system.

Another object is to provide a heat pump system having a plurality of compressor units to minimize downtime in the system, and to facilitate operation of the system even while repairs or maintenance are performed on one or more of the compressor units.

Another object is to provide means for selectively operating any one or more of the compressor units in a heat pump system during the heating and/or cooling cycles, thereby enabling each of the compressor units to be operated individually or in series.

Another object is to provide means for selecting for operation one or more from among a plurality of compressor units thereby assuring continuous heat pump system operation even when one or more of the compressor units is disabled.

Another object is to provide a heat pump system including an improved form of a heat exchanger unit which substantially reduces the possibility of freeze-ups during cold weather without sacrificing operating and economy efficiencies.

These and other objects and advantages of the present invention will become apparent to those skilled in the art after considering the following detailed specification, which discloses a preferred embodiment of a heat pump system, and centrifugal compressors and heat exchangers used therewith, in conjunction with the accompanying drawings, wherein:

DESCRIPTION OF THE PREFERRED EMBODIMENT

Figure 1:
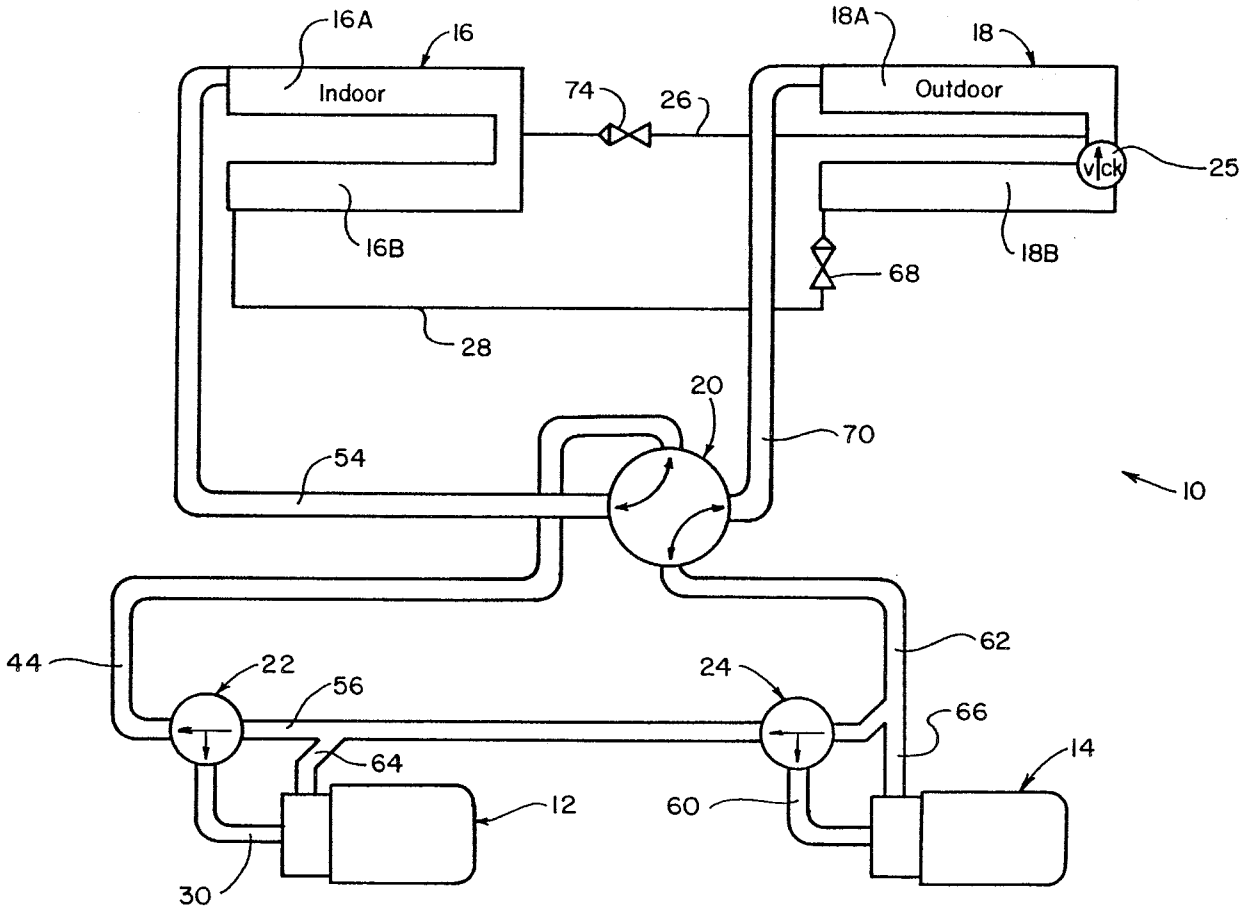
FIG. 1 is a schematic view of a heat pump system having two compressor units constructed and connected into the system according to the present invention, the system being shown in its heating mode with only one of the compressors operating.

Referring to the drawings wherein like numerals refer to like parts, number 10 in FIG. 1 refers to a preferred embodiment of an extended range heat pump system constructed according to the present invention. Heat pump systems or reversible refrigeration systems are well known mechanisms for heating and cooling residential dwellings, apartments, offices and other inhabited areas. A heat pump system provides the means to fulfill both the heating and cooling needs at a relatively low overall cost and with a relatively simple configuration as compared to more conventional systems which have a separate furnace or heating system and air conditioning system. Heat pump systems are typically promoted as being relatively efficient, although most known prior art systems become generally inefficient in their heating modes as the ambient outdoor temperature drops and are relatively inefficient at and below freezing.

The present system as shown in FIG. 1 includes a pair of compressor units 12 and 14; indoor and outdoor heat exchanger units 16 and 18; and a four-way reversing valve 20 which intersects a conduit arrangement which connects the compressor units and the heat exchanger units. The system as shown has two compressors although it should be recognized that any number of compressor units could be included in the system as desired and required. The showing of only two compressor units 12 and 14 is to simplify the disclosure and is not by way of a limitation on the system.

The present extended range heat pump system further includes novel selection means which enable each of the compressor units 12 and 14 to operate individually or in series. The selection means is shown including a pair of respective two-way, three-port selection valves 22 and 24 which operate in conjunction with the reversing valve 20. If more compressors are included, more selection valves will be required. The selection valves 22 and 24 operate to enable either or both of the compressors 12 and 14 to be operational during a heating or cooling cycle. The selection valves 22 and 24 accomplish this by providing alternate refrigerant flow paths including a refrigerant flow path bypassing either of the compressors 12 or 14 or a flow path that passes through both compressors in series. The construction and operation of the selection valves 22 and 24 will be further described with reference to FIG. 2.

The heat exchangers 16 and 18 are each adapted to serve alternatively as a condenser or evaporator during heating and cooling operations. In the system configuration shown in FIG. 1, the heat exchanger 16 is the inside unit and is located in a house or other enclosed area and the heat exchanger 18 is located outdoors. The indoor heat exchanger 16 typically would be included in a forced air heating/cooling system wherein air is blown over coils in the heat exchanger 16 and directed by ductwork to various parts of the enclosed area.

The heat exchangers 16 and 18 as shown in FIG. 1 have respective normal portions 16A and 18A which are used at all times during heating and cooling, and reserve portions 16B and 18B which are used only during the heating operation (reverse flow). This normal/reserve capacity feature is controlled by the one way expansion valves (68 and 74) and accounts for the increased availabilty of refrigerant for heat transfer in the heating mode. The outdoor heat exchanger 18 is also shown having a one way check valve 25 connected between separate portions 18A and 18B to assist in controlling its capacity during the cooling operation. Its function is to seal off section 18B from 18A with a small increase in pressure so condensation will not occur in reserve section 18B and cause a shortage of refrigerant in the cooling circuit.

In the cooling operation the outdoor heat exchanger 18 serves as a condenser unit, transferring heat energy from heated refrigerant vapor into the outdoor air and transforming the vapor into a liquid. The liquid refrigerant is then transported via a refrigerant flow line 26 to the indoor exchanger 16. The exchanger 16 in the cooling operation serves as an evaporator unit and absorbs heat energy from the indoor air, using the absorbed heat energy to evaporate the liquid refrigerant entering the heat exchanger 16, transforming the refrigerant into a vapor.

Conversely, during a heating operation the indoor heat exchanger 16 serves as the condenser unit and transmits heat energy from the refrigerant vapor passing therethrough to the air blown over its coils, thereby transforming or condensing the refrigerant vapor into a liquid refrigerant when such heat is given off. The liquid refrigerant then travels through a flow line 28 to the outdoor heat exchanger 18, which during a heating operation, acts as an evaporator, attracting and absorbing heat from the outdoor air to evaporate the liquid refrigerant, transforming it into a refrigerant vapor.

Figure 2:
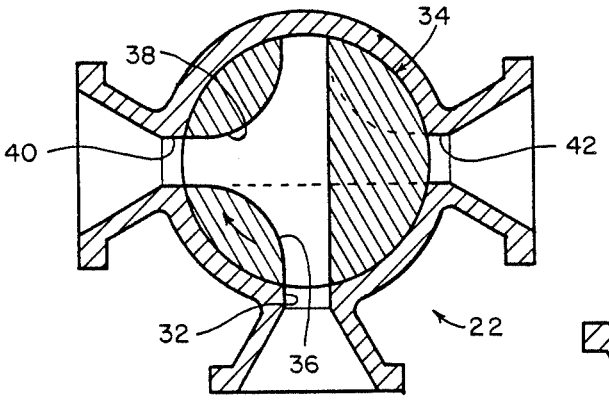
FIG. 2 is a cross-sectional view taken through the center of a two-way selection valve employed in the present system.

The selection valves 22 and 24 and the reversing valve 20 may be of known construction and are connected into the system as shown. For example, the selecting valves 22 and 24 may have constructions such as that shown in FIG. 2. The valve 22 in FIG. 2 is shown in solid outline in a first operating condition wherein the compressor unit 12 associated therewith is operating with refrigerant flowing from the output of the compressor unit 12 through conduit 30 to one of the ports 32 of the selecting valve 22. A movable member 34 in the selection valve 22 is movable between the first or open position shown in solid outline wherein connecting passage portions 36 and 38 in the member 34 establish communication between the port 32 and another valve port 40. In the second or closed position shown in phantom outline the movable member 34 establishes communication between the valve port 40 and another port 42. With the valve member 34 in the position as shown in solid outline, refrigerant flows from the outlet side of the compressor 12 through the conduit 30, to the port 32, through valve passage portions 36 and 38 in the valve member 34, through another conduit 44 to port 46 in the reversing valve 20 (FIG. 3), through V-shaped passage 48 in movable valve member 50, through port 52 and conduit 54 to the heat exchanger 16. This depends on the movable valve member 50 being in the position shown in FIG. 3. This, in turn, is controlled by means which control whether the heat pump 10 is in its cooling or heating mode.

When it is desired that the compressor 14 be operated alone, the movable member 34 in the selection valve 22 will be actuated manually or automatically as by means of a solenoid or the like to move to its alternate position wherein refrigerant flows past but not through the compressor 12. In this case the refrigerant flows through a bypass conduit 56 and then through the valve 22 between ports 42 and 40 and through the conduit 44. The structure and operation of the selection valve 22 is the same for the selection valve 24 and the description thereof will not be repeated. Other conduit members including conduits 60 and 62 are connected to the valve 24 and to the compressor 14. The conduit 60 connects the outlet side of the compressor 14 to one port of the valve 24 and the bypass conduit 56 also has a connection 64 to the inlet side of the compressor 12. In like manner the conduit 62 has a connection 66 to the inlet side of the compressor 14.

The selection valves 22 and 24 are important to the present heat pump system because they enable selective operation of the heat pump using either one of the compressors 12 and 14 individually and it enables operation using both compressors 12 and 14 connected in series with each other and with the heat exchangers 16 and 18. If both valves 22 and 24 are in the condition shown in solid outline in FIG. 2 they will be operating in series. If either valve 22 or 24 is moved to its alternate condition the compressor associated therewith will be inoperative and bypassed. Determining which of the selection valves 22 and 24 is to be in which operating position, and therefore which of the compressors is to be operating, depends on the needs of the system and the setting of the system controls. This may include timing or like means programmed to enable operation of one or more compressors for different control periods. Near the end of each such period, the operating compressor or compressors can be changed, and when a compressor is inactive it can be serviced or replaced in the system without causing operation of the system to be interrupted. This is a very important advantage. In order to replace one compressor with another under operating conditions, the compressor being brought on will be allowed time to reach its operating capacity after which the compressor to be shut down will have its associated selection valve moved to its bypass or flow-through condition. This will disable that compressor, and the system will continue efficient operation during the switchover procedure.

Means other than timer means may also be used to control the system. These can include state of the art means such as thermostatic or other temperature sensing devices usually located in the enclosed space to be heated or cooled. Such temperature sensing means can also be used to select which one or more of the compressors is needed to satisfy the heating or cooling requirements.

Figure 3:
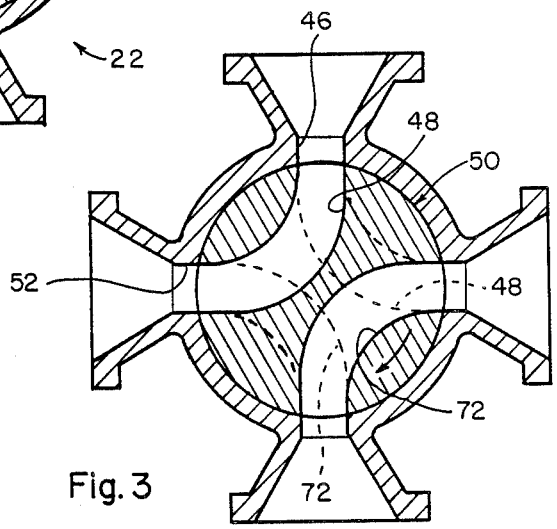
FIG. 3 is a cross-sectional view taken through the center of a four-way reversing valve employed in the system.

FIG. 3 shows the structural details of the reversing valve 20 which is an important feature of the heat pump system 10. The reversing valve 20 is provided to reverse the flow direction of the refrigerant in the system between the compressors and the heat exchangers. When the heat pump system is as shown in FIG. 1 with the reversing valve in the condition shown in FIG. 3, refrigerant flow is directed through the conduit 44 through the angularly shaped passage 48 in the movable portion 50 of the valve 20, through the conduit member 54 to and through the indoor heat exchanger 16, through the conduit 28 and the one way expansion valve 68 to and through the heat exchanger 18 and from there back to the inlet side of the compressors by way of the conduit 70, valve passage 72 in the movable valve member 50, and by way of the conduit 62 to the inlet side of the compressor 14. In this condition of the reversing valve 20, the system is set for heating. For cooling, the movable valve member 50 is moved 90° (see arrow in FIG. 3) to the condition shown in dotted outline in FIG. 3, and the output of the operating compressor or compressors is fed by way of the conduit 44 to the valve inlet port 46 which is now in communication with the conduit 70 through the valve passsage 48 instead of with the conduit 54. This also means that the fluid output from the compressors 12 and/or 14 will first be through the heat exchanger 18, and then to and through the conduit 26 and one way expansion valve 74 to and through the heat exchanger 16. From there the return path for refrigerant flow is by way of the conduit 54, the valve passage 72 to the conduit 62. In this condition, the heated refrigerant vapor from the compressor 12 and/or 14 flows through first the outdoor heat exchanger 18 and thereafter through the indoor heat exchanger 16. It can therefore be seen that the condition of the valve 20 controls whether the system is operating in its heating or cooling mode.

Figure 5:
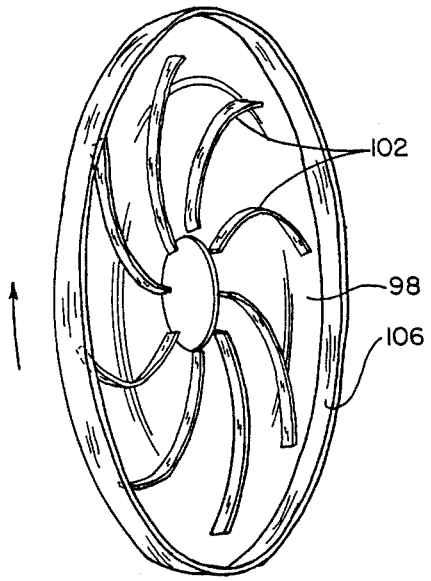
FIG. 5 is a perspective view of one of the fin sections of the compressor of FIG. 4.
Figure 6:
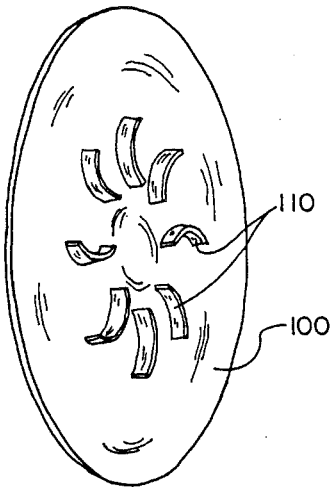
FIG. 6 is a perspective elevational view of another of the fin sections of the compressor of FIG. 4.
Figure 4:
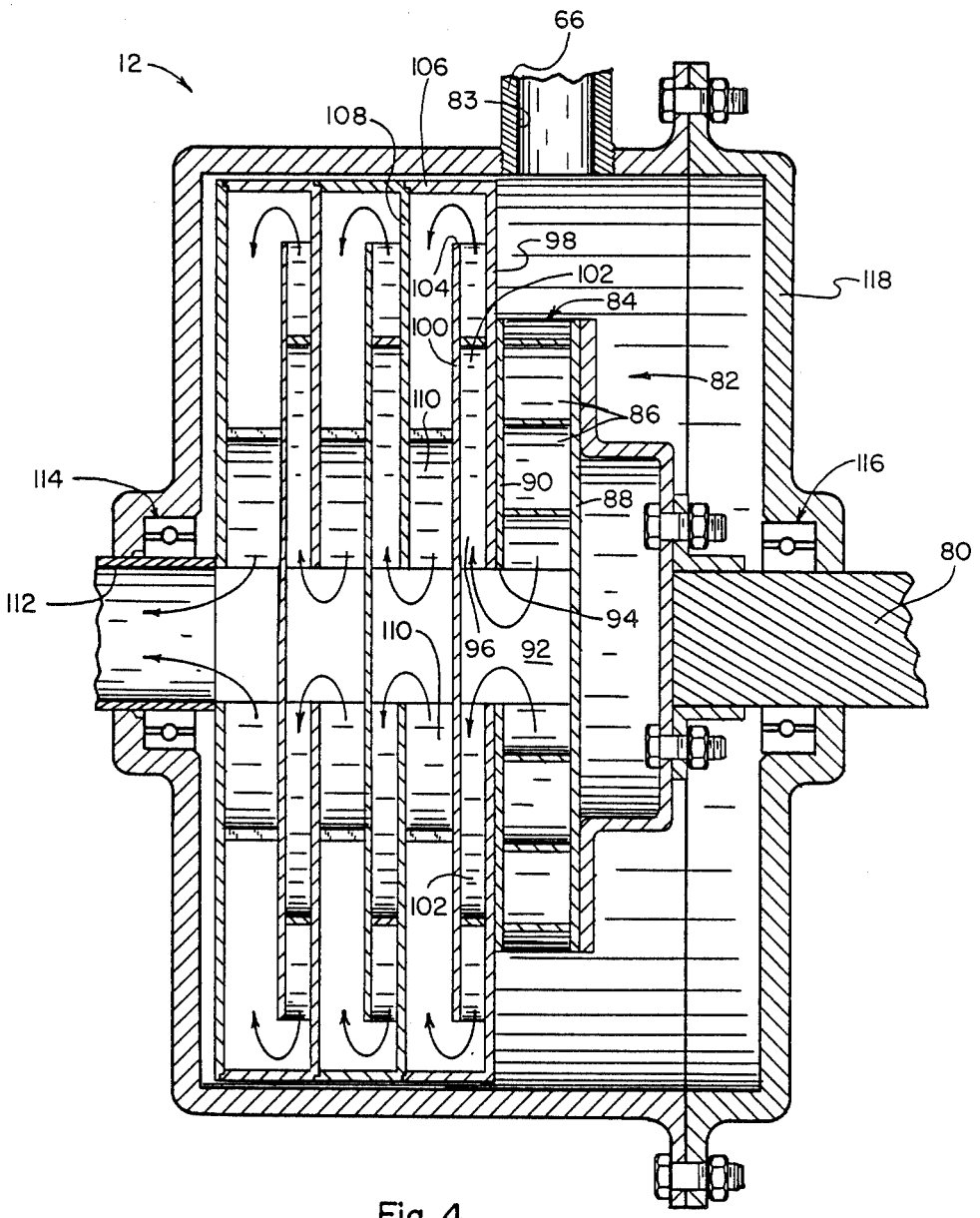
FIG. 4 is a cross-sectional elevational view through the center of an improved centrifugal compressor device.

The present heat pump may include two or more compressors which can operate independently or in series as explained above. A preferred construction for the compressors is shown in FIG. 4. In FIGS. 5 and 6 are shown more of the details of certain portion of the compressor. Each compressor such as compressor 12 includes drive motor means (not shown) which are coupled directly or indirectly to a drive shaft 80 which is connected to a rotatable compressor assembly 82 as shown in FIG. 4. The compressor 12 includes the inlet port 83 into which the refrigerant or other fluid medium is drawn or sucked by means of a suction unit 84 that includes rotating fan-like members or curved fins 86. The incoming medium or fluid is drawn into the unit 84 from the conduit 66 and moves between spaced walls 88 and 90 and between the spaced curved blades 86 mounted therebetween as shown. The refrigerant is drawn into a central chamber 92 and from there moves axially around inner edge 94 of the wall member 90 and then moves radially and circumferentially outwardly in annular space 96 defined between spaced wall members 98 and 100 and between spaced curved blower blades 102 positioned extending between the walls 98 and 100. The blades impart circumferential velocity to the fluid as it moves radially outwardly in the space 96. The wall member 100 extends outwardly to a free outer edge 104 which is spaced from an outer axial extending wall 106 which is connected to the wall 98. The outlet from the impeller blades 102 provides increased cross sectional area for passage of the fluid with a corresponding decrease in velocity and increase in pressure. Thereafter, as the medium again moves inwardly between spaced walls 100 and 108, its angular velocity increases by the law of conservation of momentum. The fins 110, shown mounted on the wall 100, then slow the circumferential speed of the fluid with a corresponding increase in pressure before entrance into the following stage. In the compressor construction shown in FIG. 4 there is provision for three sets of spaced curved blades similar to the blades 102 and three sets of spaced curved blades similar to the blades 110 suitably arranged between respective spaced walls similar to the walls 98, 100 and 108. This means that the fluid medium passing through the compressor moves radially outwardly and inwardly three separate times before it finally exits through outlet passage 112 and into the conduit 30 (or 60). All of the walls and blades are parts of the same rotating compressor assembly 82. In FIG. 4 are shown three sets of the blades 102, each set including eight blades (FIG. 5) and three sets of the blades 110 each set also shown including eight blades (FIG. 6). It is apparent, however, that the compressors 12 and 14 could have a greater or lesser number of blades and blade sets as required. The outer wall portions 106 of the several blade assemblies are also shown fitted together and the connections can be welded if necessary.

The theory of operation of the subject centrifugal compressors is such that by providing a series of adjacent sets of annular chambers through which the fluid passes it will have its pressure increased by centrifugal force and increases in velocity as described, with subsequent changes from kinetic to potential energy. However, it is recognized that it may not be necessary to have more than one or several sets of chambers in the compressors. There may also be times when even a greater number of blade sets will be needed for special circumstances.

Referring again to FIG. 4, the compressor 12 is shown having suitable means such as bearing assemblies 114 and 116 which rotatably support the assembly 82 in compressor housing 118. Seals, not shown, should also be provided to reduce or prevent leakage from the compressor housing 118. The type of fluid to be handled and compressed and the nature of the heat pump system should also be taken into account in its design.

Several variations from conventional practices are present in the design and operation of the centrifugal compressors disclosed in this application and for use with the subject extended range heat pump. As shown in FIG. 4 the impeller stages are shown the same width although the widths of the succeeding stages can be decreased if desired. The impeller chamber widths are entirely optional and the flow path can be streamlined if necessary.

Centrifugal compressors are essentially low head/-high capacity devices, but in this application the capacity requirement is expected to be relatively low so that the velocity of the vapor exiting the individual stages is relatively small compared to the peripheral velocity of the impellers. It follows therefore that the variation in volume flow rate is relatively unimportant in obtaining a balance in power requirement and performance. The important flow rate is the weight per unit time, which must be equal in compressors operating in tandem. Also, the relatively low flow rate makes refinement of the shape of the impeller exiting channels unnecessary. Of major importance to the present compressor construction is the design and refinement of the impeller blade construction, the shape of the intra stage vanes, and the form of the kinetic/potential energy change areas to provide optimum compressor performance at the flow rates involved.

Thus there has been shown and described a novel heat pump system having means for selecting from among two or more compressors for operation of the compressors in series or individually and a novel centrifugal compressor construction which produces pressure by centrifugal force and also by a substantial increase in kinetic energy which subsequently is changed to pressure energy. The present heat pump system and compressor fulfills all of the objects and advantages sought therefor. It will be apparent to those skilled in the art, however, that many changes, modifications, variations, and other uses and applications for the subject heat pump system and compressor are possible, and all such changes, modifications, variations, and other uses and applications which do not depart from the spirit and scope of the invention are deemed to be covered by the invention which is limited only by the claims which follow.

What is claimed is:

1. Improvements in heat pump systems having indoor and outdoor heat exchangers and at least two compressors for supplying a refrigerant medium under pressure thereto, and means for circulating the medium through the heat exchangers, the improvement comprising a selector valve associated with each of the compressors, said selector valves providing that any combination and any one or more of said compressors can be selected for operation, each of said selector valves having a first operating condition placing the associated compressor in series with the heat exchangers and a second operating condition whereby the associated compressor is bypassed, when the selector valves for at least two of said compressors are simultaneously in their first positions a flow path is established through the associated compressors and through the heat exchangers all in series, a two position changeover valve and associated conduit means, said changeover valve having a first position wherein at least one of the compressors is connected in series with the first and second heat exchangers to produce flow of the medium in one direction therethrough and a second position wherein said at least one compressor is connected to produce flow of the medium in the opposite direction through the heat exchangers.

2. The improvements in heat pump systems of claim 1 wherein the conduit means includes a first expansion valve located therein between the heat exchangers to produce expansion of the medium when the medium is moving through the heat exchangers in said one direction, and a second expansion valve located in the conduit means between the heat exchangers to produce expansion of the medium when the medium is moving through the heat exchangers in the opposite direction.

3. The improvements in heat pump systems of claim 1 wherein the compressors are centrifugal compressors each having a housing with a compressor assembly rotatably mounted therein, each of said rotatable assemblies having an inlet and an outlet adapted to be placed in communication with the conduit means, pump means adjacent to the inlet including a rotatable suction unit for drawing in medium through the inlet from the system, said suction unit having a central chamber, and a plurality of axially spaced radially extending wall members with deflector members positioned therebetween, a first of said wall members having a central opening in communication with the central chamber, a second of said wall members having a portion extending radially outwardly less far than the first wall member, a third of said wall members extending outwardly further than the second wall member, and a wall member extending between and connecting the peripheries of the first and third wall members whereby communication is established between the spaces on opposite sides of the second wall member through and around which medium entering the space between the first and second wall members from the central chamber can pass as it moves between the space defined by and between the first and second wall members and the space defined by and between the second and third wall members, the medium being circumferentially accelerated by the deflector members between the first and second wall members as it moves radially outward in the space between the first and second wall members, and thereafter the centrifical movement of the medium is retarded as it moves inwardly in the space between the second and third wall members by the action of the deflector members therein.

4. The improvements in heat pump systems of claim 3 including other similiar sets of space wall members spaced downstream in the compressor housing relative to the first, second, and third wall members to further radially move the medium outwardly and centrifically to increase its velocity and to thereafter again to move the medium radially inwardly while retarding its centrifugal velocity.

5. The improvements in heat pump systems of claim 1 wherein at least one of the heat exchangers has separate connected portions and one way valve means connected therebetween to permit the medium to move through both connected portions thereof in one direction of flow only.

6. Improvements in heat pump systems having indoor and outdoor heat exchangers and at least two compressors for supplying a refrigerant medium under pressure thereto, the improvements comprising said compressors being centrifugal compressors, and means including conduit means for circulating the medium through the heat exchangers, each of said compressors having a housing with a compressor assembly rotatably mounted therein, each of said rotatable assemblies having an inlet and an outlet adapted to be placed in communication with conduit means, pump means adjacent to the inlet including a rotatable suction unit for drawing in medium through the inlet from the system, said suction unit having a central chamber, and a plurality of axiallly spaced radially extended wall members with deflector members positioned therebetween, a first of said wall members having a central opening in communication with the central chamber, a second of said wall members having a portion extending radially outwardly less far than the first wall member, a third of said wall members extending outwardly further than the second wall members, and a wall member extending between and connecting the peripheries of the first and third wall members whereby communication is established between the spaces on opposite sides of the second wall member through and around which medium entering the space between the first and second wall members from the central chamber can pass as it moves between the space defined by and between the first and second and the space defined by and between the second and third wall members, the medium being circumferentially accelerated by the deflector members between the first and second wall members as it moves radially outward in the space between the first and second wall members, and thereafter the centrifugal movement of the medium is retarded as it moves inwardly in the space between the second and third wall members by the action of the deflector members therein, a selector valve associated with each of the compressors, each of said selector valves having a first operating condition placing the associated compressor in series with the heat exchangers and the second operating condition whereby the associated compressor is bypassed, when the selector valves for at least two of said compressors are simultaneously in their first positions they establish a flow path through the associated compressors and through the heat exchanges all in series, a two position changeover valve and associated conduit means, said changeover valve having a first position wherein at least one of the compressors is connected in series with the first and second heat exchangers to produce flow of the medium in one direction therethrough and a second position wherein said at least one compressor is connected to produce flow of the medium in the opposite direction through the heat exchangers.

7. The improvements in heat pump systems of claim 6 including other similar sets of spaced wall members spaced down stream in the compressor housing relative to the first, second, and third wall members to further radially move the medium outwardly and centrifugally to increase its velocity and to thereafter again move the medium radially inwardly while retarding the centrifugal velocity.

8. Improvements in heat pump systems having indoor and outdoor heat exchangers and at least two compressors for supplying a refrigerant medium under pressure thereto, and means for circulating the medium through the heat exchangers, the improvements comprising a selector valve associated with each of the compressors, each of said selector valves having a first operating condition placing the associated compressor in series with the heat exchangers and a second operating condition whereby the associated compressor is bypassed, when the selector valves for at least two of said compressors are simultaneously in their first positions they establish a flow path through the associated compressors and through the heat exchangers all in series, a two position changeover valve and associated conduit means, said changeover valve having a first position wherein at least one of the compressors is connected in series with the first and second heat exchangers to produce flow of the medium in one direction therethrough and a second position wherein said at least one compressor is connected to produce flow of the medium in the opposite direction through the heat exchanges, at least one of the heat exchangers having separate connected portions and one way valve means connected therebetween to permit the medium to move through both connected portions thereof in one direction of flow only.

* * * * *

UNITED STATES PATENT OFFICE

CERTIFICATE OF CORRECTION

Patent No. 4,739,628 Dated April 26, 1988

Inventor(s) James F. Shoemaker

It is certified that error appears in the above-identified patent and that said Letters Patent are hereby corrected as shown below:

In the Abstract, page 1, column 2, line 16, the first occurrence of the word "the" should be --to--.

Column 11, line 8, "axiallly" should be --axially--.

Column 11, line 16, "members" should be --member--.

Column 11, line 41, "exchanges" should be --exchangers--.

Column 12, line 37, "exchanges" should be --exchangers--.

Signed and Sealed this

Twenty-third Day of August, 1988

*Attest:*

DONALD J. QUIGG

*Attesting Officer*

*Commissioner of Patents and Trademarks*